United States Patent [19]

Cartwright

[11] Patent Number: 4,511,230

[45] Date of Patent: Apr. 16, 1985

[54] PHOTOGRAPHIC PROCESSING APPARATUS INCLUDING A ROCKING PLATFORM AND A ROLLING DEVELOPING TANK

[76] Inventor: Neil B. Cartwright, 693 E. 16th St., Idaho Falls, Id. 83401

[21] Appl. No.: 530,603

[22] Filed: Sep. 9, 1983

[51] Int. Cl.[3] ..... G03D 3/04

[52] U.S. Cl. ..... 354/299; 354/327; 354/329

[58] Field of Search ..... 354/327, 329, 330, 299

[56] References Cited

U.S. PATENT DOCUMENTS

| | | | |
|---|---|---|---|
| 2,493,441 | 1/1950 | Carr | 354/327 |
| 3,705,544 | 12/1972 | Ratowsky | 354/329 |
| 4,198,153 | 4/1980 | Hamlin | 354/327 |
| 4,350,430 | 9/1982 | Johnson | 354/330 |

FOREIGN PATENT DOCUMENTS

| | | | |
|---|---|---|---|
| 1241778 | 8/1971 | United Kingdom | 354/329 |

*Primary Examiner*—A. A. Mathews

[57] ABSTRACT

A photographic processing apparatus for uniformly processing roll film and photographic sheet material in a rolling stainless steel tank. The tank rolls back and forth along a platform that is tilted one way, and then the other, by means of an air bellows placed under one end of the platform. A mechanical air valve automatically shuts and opens to inflate and deflate the bellows. The apparatus can be placed in a constant temperature water bath. Electrical shock hazards are avoided since none of the electrical components are located in or near the water bath.

1 Claim, 8 Drawing Figures

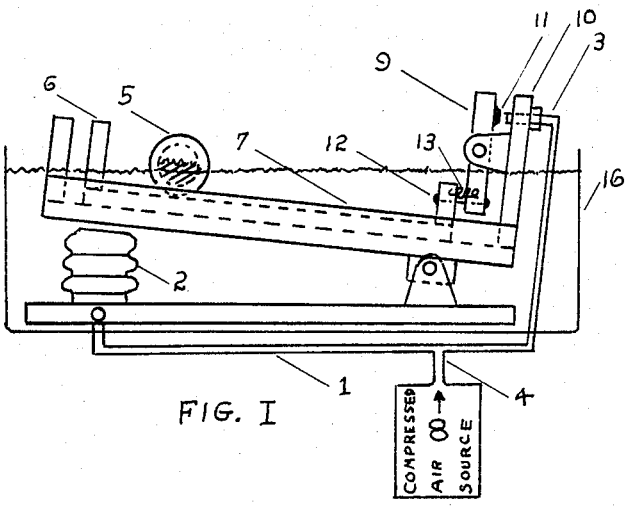
FIG. I
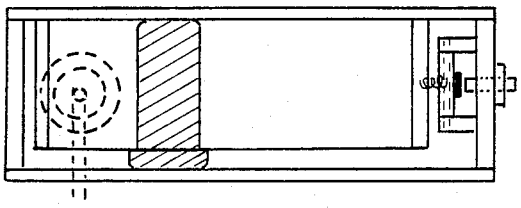
FIG. V
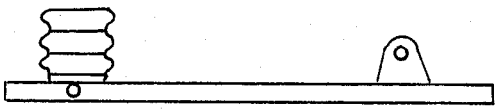
FIG. II
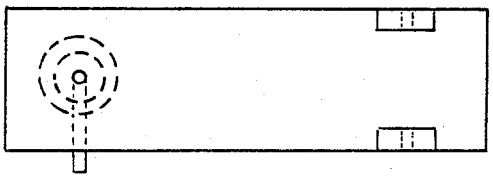
FIG. VI
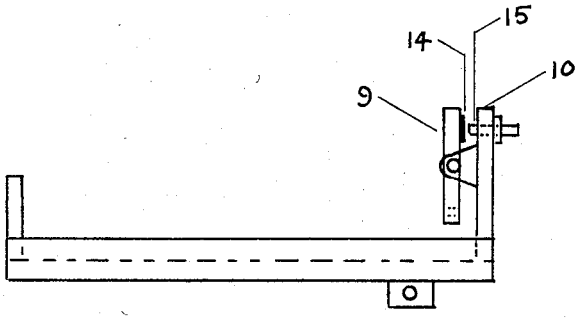
FIG. III
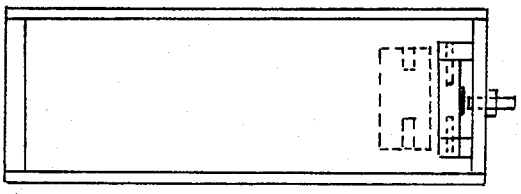
FIG. VII
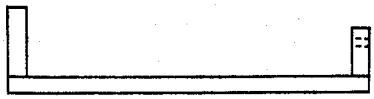
FIG. IV
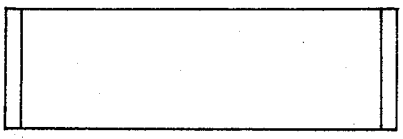
FIG. VIII

PHOTOGRAPHIC PROCESSING APPARATUS INCLUDING A ROCKING PLATFORM AND A ROLLING DEVELOPING TANK

SUMMARY

Most of the photographic processes, used for developing photographic materials, require exacting temperature control and uniform agitation. Temperature is usually controlled by immersing the developing tank in a constant temperature water bath. A circulating water pump is usually employed to provide uniform temperature throughout the bath. Agitation of the photographic material is accomplished by several mechanical devices.

The invention described, in this disclosure, provides a different improved method of agitating the photographic material while using the advantages of a constant temperature water bath. The apparatus also provides thorough agitation of the water bath without the use of a circulating water pump. As an added safety feature, the apparatus was designed to operate with air pressure to avoid shock hazards from the use of electrical components placed in or near the water bath. Photographic materials developed in this processor exhibit unusual high standards of uniformity.

DESCRIPTION OF DRAWING

FIG. 1 is a complete side view of the entire assembled machine including the water bath and a source of compressed air. The developing tank is also shown in this view. The machine is assembled from three different sections. The side views of these sections are shown in FIGS. II, III, and IV.

FIG. II is a side view of the base of the apparatus consisting of a platform with an air operated bellows and a hole in the base for introducing and exhausting the air from the bellows. This view also shows the pivot arm for attaching the rocking platform.

FIG. III is a side view of the rocking platform with side rails for holding the rolling tank in place. At the right is shown the air valve mechanism with a small flat paddle which moves back and forth on a pivot attached to the right hand vertical structure. A pivot arm is also shown at the bottom of the platform for attachment of the base shown in FIG. II.

FIG. IV is a sliding tray unit that lays on top of the rocking platform. It is attached to the lower section of the paddle, when assembled, by a small connecting pin. The rolling film tank hits against the vertical end structures of the sliding tray and thereby activates the air valve mechanism.

FIGS. V, VI, VII, and VIII are the respective top views of the side views shown in FIGS. I, II, III, and IV.

DETAILED DESCRIPTION OF APPARATUS

This machine was designed for use with stainless steel developing tanks, consisting of the tank body and a plastic lightproof lid that allows for the addition and rejection of chemical solutions without removing the lid. Stainless steel reels, containing the loaded film strips, are placed in the tank, in the dark. After placing the lid on the tank, the remaining developing steps can be performed with the light on. A tank that holds two 35 mm reels, or one 120 size reel, is normally used even though just one 35 mm reel can be used in this tank. Longer tanks that hold more than two 35 mm reels can be used on this machine. In the latter case, plastic guide rings are provided that attach to the long tanks. These guide rings follow the side rails and allow the tank to stay in the middle of the rocking platform. These tanks are very common to the photographic trade, and are readily available. Stainless steel tanks are usually employed for color processing, as it is easy to maintain an elevated temperature of the solution used by immersing the tank in a constant temperature water bath. During processing, chemical solutions are added and rejected in the proper sequence. Normally, the tank is filled one half full with the solution. However, the tank may be filled completely at the discretion of the operator.

The compressed air source, used for the operation of this unit, is not shown as this can be supplied from various sources. An excellent source, for this use, is a small air pump used for supplying air to fish aquariums. These units supply sufficient air pressure and are very compact and economical. The air is supplied through a rubber tube (1) that is connected to the bellows (2) at one end and to the valve mechanism (3) at the other end. A tee (4) is placed in the rubber tubing for the introduction of the compressed air.

During operation of the machine, the tank (5) is loaded with film and the initial solution and placed on top of the sliding tray (6 or FIG. IV). The sliding tray rests on top of the rocking platform (7 or FIG. III). The entire unit is immersed in a constant temperature water bath (16). The level of the water, in the water bath, is normally adjusted so that one half of the developing tank is immersed when the rocking platform is in a horizontal position. It should be noted that it is not always necessary to use a water bath for operation of the machine. Many of the photographic processes can be performed at room temperature. This machine works equally well when used with, or without, the use of a water bath.

When compressed air (8) is introduced, the bellows expands and rises vertically. This, in turn, causes the rocking tray to rise on the left end and the tank rolls toward the right end of the sliding tray. When the tank hits the right end of the sliding tray, the sliding tray is forced to move a small increment to the right. This action causes the sliding tray to jar against the flat paddle (9) that is pivoted to the right end vertical structure (10) of the rocking platform. This action opens the air valve (11) slightly and allows the air in the bellows to exhaust through the air valve. When the air pressure drops, the bellows collapses and the position of the rocking platform is reversed. The tank then rolls toward the left and hits the left vertical structure of the sliding tray. This action causes the sliding tray to shift slightly to the left. This, in turn, pulls on the bottom of the flat paddle and closes the air valve. The bottom of the flat paddle is connected to the sliding tray by a small loose fitting pin (12). A small stainless steel spring (13) also connects the two units to insure that the air valve will remain closed when the sliding tray is in the left position. The air valve consists of a flat pad (14) of soft rubber mounted on the flat paddle. This pad comes in contact with the open end of a soft rubber tube (15) protruding slightly through the left vertical structure of the rocking platform. The end of this tube must be cut perfectly flat by a machine operation.

As the bellows rises and falls, the tank rolls continuously back and forth from one side to the other. The rate of this action can be controlled by controlling the pressure on the compressed air system. When the tank hits either the right or left vertical structure of the sliding tray, it jars the liquid contents in the tank releasing any air bubbles that may be trapped on the film surface. In addition, the tank hits the right vertical structure with considerable force causing the reels inside the tank to rachet a slight amount in a clockwise motion. This feature is important in providing a uniformly developed film. By this means, each section of the film has equal exposure to the solution and the air phase, during the processing period. After months of extensive testing, this apparatus has been shown to produce developed film of greater uniformity than any of the known existing devices. Uniformity, over the entire surface of the film is tested by exposing each frame of the film to a gray card under the same lighting conditions, and then measuring the density of each frame and the various areas of each frame with a densitometer, after processing in various types of solutions. Existing devices include continuous rotation of the tank by a motor and shaft (or by a motor and friction wheels), or by rotation of the reels within the tank by a motor and shaft.

This invention has other unique qualities. When placed in a water bath, there is no danger of electrical shock, since only a rubber air tube supplies the energy for the mechanical action of the device. To be consistant with this feature, it is advisable to maintain the temperature of the water bath by use of a heating pad under the external surface of the water bath, or by use of hot water coils within the bath. In addition, the use of circulation water pumps, to maintain uniform temperature throughout the water bath, are not required since the back and forth rolling action of the tank provides sufficient mechanical agitation for this purpose.

This invention is not restricted to physical size. The size can be varied to meet the specific application. In addition, this invention is not restricted to the processing of photographic roll film. Large units can be fabricated for the processing of photographic paper sheets or photographic film sheets. The invention is not limited to photographic use. There are many application, in industry, where this apparatus could be used.

I claim:

1. Apparatus for uniformly processing photographic roll film, or photographic sheet material, said apparatus comprising: a base for supporting a rocking platform attached to said base, a sliding tray that slides back and forth on said rocking platform, said tray supporting a rolling developing tank, means for raising and lowering said rocking platform at one end by use of an air bellows, causing said tank to roll back and forth, means for supplying compressed air to said bellows, means for alternately introducing and exhausting air from said bellows by use of a mechanical air valve, said valve activated by action of said sliding tray alternately jarring and pulling an air valve paddle that opens and shuts said air valve, means for regulating the rate of rolling of said developing tank by adjusting the air supply pressure, means for operating the apparatus in a constant temperature water bath.

* * * * *